United States Patent [19]

Baltazzi et al.

[11] 4,055,684

[45] Oct. 25, 1977

[54] COATED CARRIER PARTICLES FOR USE IN ELECTROPHOTOGRAPHIC PROCESS

[75] Inventors: Evan Serge Baltazzi, Northfield; Pabitra Datta, Lyndhurst, both of Ohio

[73] Assignee: Addressograph Multigraph Corporation, Cleveland, Ohio

[21] Appl. No.: 682,310

[22] Filed: May 3, 1976

Related U.S. Application Data

[62] Division of Ser. No. 528,712, Dec. 2, 1974.

[51] Int. Cl.[2] ..... G03G 13/09; G03G 9/10; G03G 9/14

[52] U.S. Cl. ..... 427/18; 96/1 SD; 252/62.1 P; 427/14; 427/20; 427/213; 428/407

[58] Field of Search ..... 427/14, 18, 20, 21, 427/213, 221; 252/62.1; 96/150; 428/407

[56] References Cited

U.S. PATENT DOCUMENTS

| | | | |
|---|---|---|---|
| 3,725,118 | 4/1973 | Fuller et al. | 252/62.1 X |
| 3,793,048 | 2/1974 | Nagashima et al. | 252/62.1 X |
| 3,898,170 | 8/1975 | Kasper | 252/62.1 |

FOREIGN PATENT DOCUMENTS

| | | | |
|---|---|---|---|
| 1,174,571 | 12/1969 | United Kingdom | 252/62.1 |

*Primary Examiner*—James R. Hoffman
*Assistant Examiner*—Stuart D. Frenkel
*Attorney, Agent, or Firm*—Michael A. Kondzella

[57] ABSTRACT

Carrier particles for use in an electrophotographic process are prepared by coating a particulate matrix with an ion exchange resin dispersed in a polymeric binder. The resulting coated carrier particles are long lived and depending upon the choice of ion exchange resin can be used to impart a positive or negative triboelectric charge of the magnitude desired to electroscopic powders mixed therewith.

10 Claims, No Drawings

COATED CARRIER PARTICLES FOR USE IN ELECTROPHOTOGRAPHIC PROCESS

This is a division, of application Ser. No. 528,712 filed Dec. 2, 1974.

BACKGROUND OF THE INVENTION

This invention relates to carriers for use in developer formulations which charge electroscopic powders triboelectrically. These carriers are useful in electrophotographic processes for developing latent electrostatic images in which a colored toner adhered to the surface of a carrier particle is caused to be attracted from the carrier particle to develop a latent electrostatic image.

In the electrophotograhic process it is necessary to use a carrier for the toner in order to produce an electrostatic charge upon the toner particles. Various kinds of developing processes are known including cascade, powder cloud and magnetic brush processes. In each of these processes it is necessary that the carrier used have certain triboelectric properties so tht it is capable of imparting to the toner particles an electrostatic charge of the proper polarity and magnitude. Where uncoated carrier particles are used it has been necessary to select a toner having the desired triboelectric properties. Recently it has been found that the carrier particles can be coated with various types of polymeric coatings to permit variations in the triboelectric properties thereof. One such method is disclosed in U.S. Pat. No. 3,811,880 to Luther C. Browning assigned to the same assignee as this invention. Although polymeric coatings of this type enable a certain degree of control of the triboelectric properties of the developer mix, it has been found that in use in the environment of electrophotographic reproduction machines such carrier particles are subject to aging which limits their effectiveness. Wearing away and removal of part of the polymeric coating upon the surface of the carrier particles is another problem encountered. This may result in undesired abrasion of the photoconductive surface used for imaging and may also cause bias shorting.

Another problem inherent in the use of this type of polymeric coating for carrier particles is the phenomenon known as "bound toner". Through a mechanism which is not clearly understood prolonged usage of developer mixes including polymeric coated carrier particles results in toner being adhered onto the surface of the coated carrier causing a decrease in the effectiveness of the toning process and hence in the overall development of the images being reproduced.

OBJECTS

It is accordingly an object of this invention to provide carriers for toners which are not subject to the disadvantages mentioned above.

Another object of this invention is to provide carrier particles which have an enhanced longevity.

Another object of this invention is to provide carrier particles which are capable of imparting desired triboelectric properties to various types of toners.

Other objects and advantages of this invention will become apparent in the following detailed disclosure and description.

SUMMARY OF THE INVENTION

Carrier particles consisting of a solid matrix coated with a dispersion of an ion exchange resin in a polymeric binder can be used in developer mixes in order to provide a means for controlling the triboelectric charge induced in an electroscopic powder mixed therewith.

Use of the carriers of this invention permits matching the carrier to the desired electroscopic powder or toner in order to impart the requisite triboelectric properties thereto. This results in a wide latitude of toner formulations being useful rather than requiring, as heretofore, that toners be specially formulated to have the triboelectric properties required for the particular positive or negative development involved in the electrophotographic process.

Ion exchange resins can be selected to charge whichever toner is chosen positively or negatively as desired.

In addition to the advantageous triboelectric properties possessed by these carriers, their use results in developer mixes which are longer lived and less susceptible to toner filming than previously available developer mixes.

DESCRIPTION OF THE PREFERRED EMBODIMENTS

The ion exchange resins suitable for use in this invention include both cation exchange resins and anion exchange resins. These ion exchange resins are polymeric entities having various types of ionic moieties incorporated therein. The backbone of the ion exchange resin, for example can be a copolymer of styrene and divinylbenzene which is highly cross-linked and has exceptional physical strength and chemical stability. In the case of cation exchange resins the ionic moieties are generally sulfonic acid or cation exchange resins the ionic moieties are generally sulfonic acid or carboxylic acid groups while in the case of anion exchange resins, which can be weakly basic or strongly basic ion exchange resins, the ionic moieties are various types of amines. In the case of highly basic anion exchange resins quartetnary ammonium compounds may serve as the ionic moiety. Such ion exchange resins are usually provided in the form of hard opaque spheres or beads. A wide variety of such ion exchange resins are commercially available.

The ion exchange resin to be used is dried and finely ground and then dispersed in a polymeric binder. The sizes of the ion exchange resin particles which are used in the dispersion are preferably in the micron to submicron range.

The binder is a polymeric material which may be characterized as a low surface energy thermoplastic polymer. Use of such a binder increases the developer mix life and prevents toner filming and bias shorting. Some materials which are especially adapted for this purpose are polycarbonate resins, acrylic resins, novolak resins, heat curable silicone rubbers, fluorinated polymers and other low surface energy polymers.

As carrier matrix materials it is possible to use a wide variety of substances, for example glass beads, ceramic beads, grains of sand or metallic particles. Non-metallic matrix materials are useful for use in cascade development systems. Where a magnetic brush developing system is used it is necessary that the matrix be magnetic. For this purpose various irons and steels have been used, for example spherical steel beads and irregularly shaped iron powders.

The desired carriers can be prepared by dispersing the finely divided ion exchange resins in the binder in a pigment to binder ratio of about from 1:1 to 2:1.

The dispersion of ion exchange resin in polymeric binder is prepared using a suitable solvent for the binder, which may be present therein in a concentration of about from 1% to 10% by weight of the polymer solution. Dispersion may be facilitated by the use of a blender or other high speed mixing apparatus. Following dispersion of the ion exchange resins in the binder solution the resulting formulation is diluted to the desired total solids, for example to a range of about from 1% to 10% total solids in the dispersion. At this time if the binder being used requires a catalyst such as catalyst vulcanized silicones, the catalyst is added to the dispersion.

Coating of the carrier matrix material is accomplished by a process which will thoroughly mix the carrier matrix particles and the dispersion to achieve uniform coating of the carrier matrix. A fluidized bed coating apparatus has been found particularly adaptable to the coating operation although other coating techniques can also be used. In using the fluidized bed coating method, the carrier matrix material is loaded into the fluidized bed coating apparatus and air under pressure is then passed into the apparatus. The ion exchange dispersion is pumped through an atomizing spray nozzle at a rate such that uniform coatings occur. Spraying may be repeated as many times as desired to obtain the particular thickness of coating required. A coating thickness, for example, of about from 1 micron to 3 microns has been found to be particularly satisfactory for use with a wide variety of toners. The resulting coated particles are finally dried in a fluidized bed oven.

As pointed out above use of the carriers of this invention results in developer mixed in which they are used having a longer useful life than using prior art carriers in an environment of electrophotographic development. Because these carriers have a low surface energy, reduced toner filming is also realized. The adherence of the coating to the carrier matrix is such that these carriers can be used for extended periods of time without replacement.

The triboelectric properties of the carriers of this invention, as previously mentioned, permit predicting the polarity to which any particular toner will be charged. In general cation exchange resins impart a positive triboelectric charge to the toner and can be used in he positive development of photoconductors which are capable of accepting a negative electrostatic charge, while anion exchange resins impart 8 negative triboelectric charge to the toner and can be used in the positive development of photoconductors which are capable of accepting a positive electrostatic charge. Either type of ion exchange resin may also be used in reversal development.

A wide variety of photoconductors are known including inorganic materials like selenium or zinc oxide and various organic photoconductors such as polyvinylcarbazole, the polyvinylbenzocarbazoles described in U.S. Pat. No.3,751,246 to Helen C. Printy and Evan S. Baltazzi and polyvinyliodobenzocarbazoles described in U.S. Pat. No. 3,764,316 to Earl E. Dailey, Jerry Barton, Ralph L. Minnis and Evan S. Baltazzi. Other organic photoconductors which may be used include monomeric photoconductors which require dispersion in a resin binder. These photoconductors include the benzofluorenes and dibenzofluorenes described in U.S. Pat. No. 3,615,412 to William J. Hessel and the cumulenes described in U.S. Pat. No. 3,674,473 to Robert G. Blanchette all assigned to the same assignee as this invention. In many instances the organic photoconductors mentioned above may be used with a suitable sensitizer to extend the spectral range of the photoconductor. Dyes may be used for this purpose. Another class of materials which are widely used are the pi acids. Representative of these compounds are the oxazolones and butenolide derivatives of fluorenone described in U.S. Pat. No. 3,556,785 to Evan S. Baltazzi, the dicyanomethylene substituted fluorenes described in U.S. Pat. No. 3,752,668 to Evan S. Baltazzi, and the bianthrones described in U.S. Pat. No. 3,615,411 to William J. Hessel, all assigned to the same assignee as this invention.

Zinc oxide and similar photoconductors are capable of accepting a negative electrostatic charge while the cumulenes and selenium are capable of accepting a positive charge. Polyvinylcarbazole, the polyvinylbenzocarbazoles and the polyvinyliodobenzocarbazoles are capable of accepting either a positive or a negative charge as desired.

With the outstanding triboelectric properties of the carriers of this invention and the physical properties mentioned above, namely the low surface energy and the durability of these coated carriers, a significant improvement over carriers which have been previously used is realized. In addition to the long life of the carriers themselves and the developer mixes in which they are used the particular combination of properties possessed by these carriers serves to increase the life of the photoconductor used in the electrophotographic process and also results in copies of a very high quality being produced by their use.

This invention will be better understood by reference to the following examples which are intended to illustrate this invention, the scope of which is defined in the claims appended hereto.

EXAMPLE 1

A quantity of 1000 grams of Dowex MSC-1 cation exchange resin was dried in a fluidized bed dryer at 100° C for 1 hour, pulverized in a jet mill and sifted through a 325 mesh screen. A 20 gm. quantity of resulting powdered cation exchange resin was dispersed in 400 grams of a 5% solution of a copolymer of vinylidene fluoride and tetrafluoroethylene (Pennwalt Kynar -7201) in a 1:1 mixture of methylethylketone and acetone to give a pigment to binder ratio of 1:1. This mixture was then placed in a blender and blended for 30 minutes after which it was diluted with the methylethylketone-acetone mixture mentioned above to give a 5% total solids concentration in the resulting dispersion.

A 4 kilogram quantity of 175 micron average particle size spherical steel beads was loaded into a fluidized bed coating apparatus. Air was introduced at 15 CFM and the frequency of the apparatus was adjusted to 6,000 rpm. The ion exchange dispersion described above was pumped through an atomizing spray nozzle. The entire dispersion was applied in about 40 spray cycles repeated at 5 minute intervals. The resulted coated steel beads were then dried in a fluidized bed oven at 100° C for 2 hours.

EXAMPLE 2

A quantity of 1500 grams of the coated carrier particles of Example 1 were mixed with 22.5 grams of a toner containing polymers prepared from styrene and acrylic monomers, polyvinylbutyral and carbon black.

The resulting developer mix was poured into the toning unit of an Addressograph-Multigraph Model 2000 electrostatic copying machine. Copies of a photographic transparency were made using zinc oxide coated paper. The optical density of the copies obtained was determined by means of a Macbeth Densitometer. The copies were found to have an optical density of 1.4. The copy density was maintained for up to 60,000 copies.

EXAMPLE 3

A quantity of 1500 grams of the coated carried particles of Example 1 was mixed with 22.5 grams of a toner containing polyamide resin, maleic modified rosin, polyketone resin, polyethylene, lithium stearate, carbon black and a positive orienting dye. The resulting developer was poured into the toning unit of an Addressograph-Multigraph Model 2000 electrostatic copying machine. Copies of a photographic transparency were made using zinc oxide coated paper. The optical density of the image produced was 1.5 with no degradation of density observed up to 50,000 copies.

Triboelectric properties of this toner were determined in the following manner.

A sheet of toner about 1 mm. thick was formed upon a steel plate by melting the toner onto the metal. The resulting toner sheet was then gently rubbed in the carrier and the carrier was removed by shaking or lightly vacuuming the toner sheet.

The triboelectric interaction between the toner sheet and carrier deposited a surface charge on the toner sheet. The surface charge caused a voltage drop across the toner sheet which was then measured with a non-contact voltmeter such as a Monroe Electronics "Isoprobe".

For a sheet of dielectric of area A, thickness $t$, dielectriconstant K, and bulk resistivity $\rho$, with a surface charge density of $+(\sigma_c)$ on the top surface and $-(\sigma_c)$ on the bottom surface the equivalent circuit is a capacitor of capacity $$C = K\,\epsilon_o A/t$$

in parallel with a resistance $$R = \rho\, t/A$$

with a voltage across the plates of:

$$V_c = [(\sigma_c)\, t]/K\,\epsilon_o$$

where $\epsilon_o$ is the permittivity of free-space.

The surface charge density $\sigma_c$ associated with the toner-carrier triboelectric interaction was thus easily calculated from the measured voltage drop across the toner sheet, the dielectric constant and the thickness of the sheet.

The sheet thickness was determined by measuring the thickness of the sheet plus metal plate with calipers and substracting the measured thickness of the bare metal plate. The sheet dielectric constant was determined in the standard manner by (1) measuring the capacitance of the sheet placed between electrodes of known area, and (2) dividing that value by the calculated unloaded capacitance of the electrodes separated by a space equal to the sheet thickness.

Toner sheets made by carefully melting the toner powder onto the plate were often found to have edges slightly lower the centers. In order to avoid any inaccuracies occasioned by the method of sheet preparation care was taken to measure the voltage only in the regions where the thickness was uniform and easy to measure.

Using the above described technique this toner was found to have a surface charge density $\sigma_c$ of $+5 \times 10^{-10}$ coulomb per square centimeter.

EXAMPLE 4

A quantity of 150 grams of the coated carrier particles of Example 1 was mixed with 2.2 grams of a toner containing polyamide resin, polyol, maleic anhydride polyhydric alcohol modified rosin, carbon black and a positive orienting dye.

Zinc oxide coated paper was charged negatively by means of a corona discharge using a potential of 5,000 volts exposed through a photographic transparency and toned with a hand-held magnetic brush using the resulting developer. Positive images having a density of 1.0 were obtained. The surface charge density was found to be $+8 \times 10^{-10}$ coulomb per square centimeter.

EXAMPLE 5

A quantity of 150 grams of the coated carrier particles of Example 1 was mixed with 2.2 grams of a toner containing copolymers of styrene and n-butylmethacrylate, maleic modified rosin, polyvinyl stearate and carbon black. Zinc oxide coated paper was charged negatively by means of a corona discharge using a potential of 5,000 volts, exposed through a photographic transparency and toned with a hand-held magnetic brush using the resulting developer. Positive images having a density of 1.3 were obtained. The surface charge density was found to be $+1.8 \times 10^{-10}$ coulomb per square centimeter.

EXAMPLE 6

The procedure of Example 1 was followed except that irregularly shaped iron powder having a particle size range of 75 microns to 200 microns was used.

EXAMPLE 7

A quantity of 4 kilograms of the coated carrier particles of Example 6 was mixed with 75 grams of the toner of Example 3. The resulting developer mix was poured into the developer unit of an Addressograph-Multigraph Model 5000 electrostatic copier. Copies having a copy density of 1.1 were obtained. The surface charge was determined to be $4.4 \times 10^{-10}$ coulomb per square centimeter. No degradation of image density was observed even under extreme humidity conditions within the range of relative humidities of 10% to 75%.

EXAMPLE 8

A quantity of 1500 grams of the coated carrier particles of Example 6 was mixed with 22.5 grams of the toner of Example 2. The resulting mixture was then poured into the toning unit of an Addressograph-Multigraph Model 2000 electrostatic copier. Zinc oxide coated electrostatic paper was charged under a corona and exposed through a photographic transparency and then toned with the toner unit. Copies having a density of 1.3 were obtained. The surface charge on toner was found to be $+0.5 \times 10^{-10}$ coulomb per square centimeter.

EXAMPLE 9

A quantity of 150 grams of the coated carrier particles of Example 6 was mixed with 2.2 grams of the toner of Example 4. Zinc oxide coated electrostatic paper was charged negatively by means of a corona discharge using a potential of 5000 volts, exposed through a photographic transparency and toned with a hand-held magnetic brush using the resulting developer mix. Copies displaying an image density of 1.1 were obtained. Surface charge on the toner was found to be $+7 \times 10^{-10}$ coulomb per square centimeter.

EXAMPLE 10

A quantity of 150 grams of the coated carrier particles of Example 6 was mixed with 2.2 grams of the toner of Example 5. Zinc oxide coated paper was imaged according to the procedure of Example 9. Copies displaying an image density of 1.4 were obtained. The surface charge on the toner was found to be $+2 \times 10^{-10}$ coulomb per square centimeter.

EXAMPLE 11

A quantity of 500 grams of Dowex MSC-1 cation exchange resin was pulverized in a jet mill and then sifted through a 325 mesh screen. A 20 gm. quantity of powdered cation exchange resin was then dispersed in 400 grams of a 5% solution of externally catalyzed silicone (General Electric Silicone 4191) in tetrahydrofuran-acetone solvent. The pigment to binder ratio was 1:1. The resulting dispersion was placed in a blender and blended for 30 minutes and then diluted to obtain a concentration of 5% total solids in the dispersion. Then 0.8 gram of catalyst (General Electric Catalyst 4192-C) was added to the dispersion in a concentration of 4% by weight of silicone.

The resulting dispersion was used as in Example 1 to coat a 4 kilogram quantity of 175 microns average particle size spherical steel beads. The resulting coated steel beads contained 1.0% by weight of the cation exchange resin dispersion. The coating thickness was 1 to 2 microns.

EXAMPLE 12

A quantity of 150 grams of the coated carrier particles of Example 11 was mixed with 2.25 grams of the toner of Example 2. Zinc oxide coated electrostatic paper was charged with a corona, exposed through a photographic transparency and toned with a hand-held magnetic brush using the developer mix described above. Copies having an image density of 1.3 were obtained. The surface charge on toner was found to be $+0.5 \times 10^{-10}$ coulomb per square centimeter.

EXAMPLE 13

A quantity of 1500 grams of the coated carrier particles of Example 11 was mixed with 22.5 grams of the toner of Example 3. The resulting developer mix was poured into the toning unit of an Addressograph-Multigraph Model 2000 electrostatic copier. Zinc oxide coated electrostatic paper was charged under a corona, exposed through a photographic transparency and then toned with the toning unit. Copies having a copy density of 1.1 were obtained. The surface charge on toner was found to be $+3 \times 10^{-10}$ coulomb per square centimeter. The excellent quality of the copies obtained continued up to 100,000 copies.

EXAMPLE 14

A quantity of 150 grams of the coated carrier particles of Example 11 was mixed with 2.25 grams of the toner of Example 4. Imaging and development was accomplished in the manner described in Example 12. Copies displaying a density of 1.0 were obtained. The surface charge on toner was found to be $+6 \times 10^{-10}$ coulomb per square centimeter.

EXAMPLE 15

A quantity of 150 grams of the coated carrier particles of Example 11 was mixed with 2.25 gm. of the toner of Example 5. Imaging and development was accomplished in the manner described in Example 12. Copies displaying an image density of 1.4 were obtained. Surface charge on toner was found to be $+1.5 \times 10^{-10}$ coulomb per square centimeter.

EXAMPLE 16

A quantity of 500 grams of Dowex MSC-1 cation exchange resin was pulverized with a jet mill and sifted through a 325 mesh screen. A 40 gm. quantity of the powdered cation exchange resin was then dispersed in 400 grams of a 5% solution of polycarbonate resin in chloroform (General Electric Lexan −140). The pigment to binder ratio was 2:1. The resulting formulation was placed in a blender, blended for 30 minutes and then diluted to obtain 5% total solids in the resulting dispersion.

The resulting dispersion was used to coat 4 kilograms of iron powder having a particle size range of 75 microns to 200 microns. A quantity of 400 grams of the coated iron powder was mixed with 10 grams of the toner of Example 2.

Zinc oxide coated paper was charged negatively, exposed through a photographic transparency and toned with a hand-held magnetic brush. Copies without any background were obtained.

EXAMPLE 17

A 3 kilogram quantity of the coated carrier particles of Example 16 was mixed with 75 grams of the toner of Example 3. Copies were produced on zinc oxide coated paper using the Addressograph-Multigraph Model 5000 electrostatic copier at 10% relative humidity. Excellent copies displaying an image density of 1.2 were produced for a period of 7 days with no image reversal being observed. Surface charge on toner was found to be $+4 \times 10^{-10}$ coulomb per square centimeter.

In a similar experiment using uncoated iron powder instead of the coated carrier particles of this invention image reversal was observed.

EXAMPLE 18

A quantity of 150 grams of the coated carrier particles of Example 16 was mixed with 3.7 grams of the toner of Example 4. Zinc oxide coated paper was charged negatively, exposed through a negative transparency and developed with a hand-held magnetic brush containing the above-described developer mix. Copies having an image density of 1.2 were obtained. The surface charge on toner was found to be $+2.5 \times 10^{-10}$ coulomb per square centimeter.

EXAMPLE 19

The procedure of Example 16 was followed using the same quantity of 150 micron average particle size spherical steel beads. A quantity of 150 grams of coated carrier particles was mixed with 2.23 grams of the toner of Example 2. Imaging was accomplished in a manner similar to that described in Example 18. Copies obtained displayed an image density of 1.3. The surface charge on toner was found to be $+0.3 \times 10^{-10}$ coulomb per square centimeter.

EXAMPLE 20

A quantity of 150 grams of the coated carrier particles of Example 19 was mixed with 2.25 grams of the toner of Example 3. Use of a hand-held magnetic brush produced copies from zinc oxide coated paper having an image density of 1.2. The surface charge on toner was found to be $+2.5 \times 10^{-10}$ coulomb per square centimeter.

EXAMPLE 21

A quantity of 500 grams of Dowex MSA-1 anion exchange resin was pulverized with a jet mill and sifted through a 325 mesh screen. A 20 gram quantity of the powdered anion exchange resin was then dispersed in 400 grams of a 5% solution of externally catalyzed silicone (General Electric 4191 Silicone) in a 1:1 mixture of tetrahydrofuran and acetone. The pigment to binder ratio was 1:1. The resulting dispersion was placed in a blender, blended for 30 minutes and then diluted to obtain a 5% total solids dispersion. A quantity of 0.8 gram of catalyst (General Electric Catalyst 4192-C) was added to the resulting dispersion in a concentration of 4% by weight of silicone. The dispersion was then used to coat a 4 kilogram quantity of 150 micron average particle size spherical steel beads using a fluidized bed coating apparatus as described in Example 1. The coating resulting from this treatment constituted 1.5% of the weight of the coated steel beads. The coating thickness was 1 to 2 microns.

EXAMPLE 22

A quantity of 150 grams of the coated carrier particles of Example 21 was mixed with 3.7 grams of the toner of Example 3. Paper coated with 1,4-diphenyl-1,4-di(4-phenyllphenyl)butatriene sensitized with 9-dicyanomethylene)-2,4,7-trinitrofluorene was charged positively with a corona using a potential of 5,000 volts, exposed through a photographic transparency and toned with a hand-held magnetic brush using the resulting developer mix. Positive copies displaying a copy density of 1.5 were obtained. The surface charge on toner was found to be $-2.5 \times 10^{-10}$ coulomb per square centimeter.

EXAMPLE 23

A quantity of 150 grams of the coated carrier particles of Example 21 was mixed with 2.2 grams of the toner of Example 2. Imaging was accomplished as in Example 22. Excellent copies were produced.

EXAMPLE 24

A quantity of 150 grams of the coated carrier particles of Example 21 was mixed with 2.2 grams of the toner of Example 4. Imaging was accomplished as in Example 22. Excellent copies were observed. The surface charge density on toner was found to be $-5 \times 10^{-10}$ coulomb per square centimeter.

EXAMPLE 25

A quantity of 150 grams of the coated carrier particles of Example 21 was mixed with 2.2 gram of the toner of Example 5. Imaging was accomplished as described in Example 22. Excellent copies displaying an image density of 1.2 were obtained. The surface charge density on toner was found to be $-2.2 \times 10^{-10}$ coulomb per square centimeter.

EXAMPLE 26

The procedure of Example 21 was repeated using an externally catalyzed silicone (General Electric Silicone 4164) and a catalyst (General Electric Catalyst 4163-C) as the binder.

A quantity of 150 grams of the coated carrier particles prepared in this manner was mixed with 3.7 grams of the toner of Example 2. Imaging was accomplished in accordance with the procedure of Example 22. Excellent copies displaying an image density of 1.1 were produced. The surface charge on the toner was found to be $-5 \times 10^{-11}$ coulomb per square centimeter.

EXAMPLE 27

The procedure of Example 26 was followed using the toner of Example 3. The surface charge density on toner was found to be $-2.5 \times 10^{-10}$ coulomb per square centimeter.

EXAMPLE 28

The procedure of Example 26 was followed using the toner of Example 4. The surface charge on toner was found to be $-1.5 \times 10^{-10}$ coulomb per square centimeter.

EXAMPLE 29

The procedure of Example 26 was followed using the toner of Example 5. The surface charge on toner was found to be $-2 \times 10^{-10}$ coulomb per square centimeter.

EXAMPLE 30

The procedure of Example 26 was followed using as binder a polycarbonate resin (General Electric Lexan 140). With the toner of Example 2 the surface charge on the toner was found to be $-0.2 \times 10^{-10}$ coulomb per square centimeter. Excellent copies were produced using the method of Example 22.

EXAMPLE 31

The procedure of Example 30 was followed using the toner of Example 3. The surface charge on toner was found to be $-1.5 \times 10^{-10}$ coulomb per square centimeter. Excellent copies were produced using the method of Example 22.

EXAMPLE 32

The procedure of Example 30 was followed using the toner of Example 5. the surface charge on toner was found to be $-1.2 \times 10^{-10}$ coulomb per square centimeter. Excellent copies were produced using the method of Example 22.

It can thus be seen that the carriers of this invention can be used to produce high quality copies using a variety of toners and photoconductors. Of particular interest is the ability of the carriers of this invention to impart a charge of the desired polarity regardless of choice of toner and photoconductor.

This invention has been described with respect to a limited number of specific embodiments. However, it is intended that alternative compositions and methods can be used and it is to be understood that this invention is not to be limited except in accordance with the claims appended hereto.

We claim:

1. A process for developing a visual image from a latent electrostatic image which comprises applying to the surface upon which is formed the latent electrostatic image a developer mix comprising a finely divided electroscopic powder and discrete solid carrier particles selected from the group consisting of glass beads, ceramic beads, grains of sand and metallic particles, coated with a dispersion in a low surface energy thermoplastic polymeric binder of dried, finely ground particles in the micron to submicron range of a polymer consisting essentially of a backbone of a highly cross-linked copolymer of styrene and divinylbenzene having ion exchanging groups chemically bonded thereto; said coating being about from 1 micron to 3 microns in thickness.

2. A process according to claim 1 wherein a positive electrostatic charge is imparted to particles of said electroscopic powder.

3. A process according to claim 1 wherein a negative electrostatic charge is imparted to particles of said electroscopic powder.

4. A process according to claim 1 wherein the electroscopic powder is applied to the surface carrying the latent electrostatic image by means of a magnetic brush and a positive electrostatic charge is induced in the particles of the electroscopic powder upon their separation from said carrier particles.

5. A process according to claim 1 wherein the electroscopic powder is applied to the surface carrying the latent electrostatic image by means of a magnetic brush and a negative electrostatic charge is induced in the particles of the electroscopic powder upon their separation from said carrier particles.

6. A process according to claim 1 wherein the development of the latent electrostatic image is a direct development process.

7. A process according to claim 1 wherein the development of the latent electrostatic image is a reversal development process.

8. A process according to claim 1 wherein the ion exchanging groups are cation exchanging groups.

9. A process according to claim 1 wherein the ion exchanging groups are anion exchanging groups.

10. A process according to claim 1 wherein said ion exchanging groups are selected from the group consisting of carboxylic acid groups, sulfonic acid groups, quaternary ammonium groups and amino groups.

* * * * *

UNITED STATES PATENT AND TRADEMARK OFFICE

CERTIFICATE OF CORRECTION

PATENT NO. : 4,055,684

DATED : October 25, 1977

INVENTOR(S) : Evan Serge Baltazzi and Pabitra Datta

It is certified that error appears in the above-identified patent and that said Letters Patent are hereby corrected as shown below:

Column 2, line 33, "cation exchange resins the" should be deleted;
line 34, "ionic moieties are generally sulfonic acid or" should be deleted.

Column 3, line 46, "he" should be deleted and "the" substituted therefor;
line 48, "8" should be deleted and "a" substituted therefor.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*